US009756938B2

(12) United States Patent
Ueda

(10) Patent No.: US 9,756,938 B2
(45) Date of Patent: Sep. 12, 2017

(54) STORAGE DEVICE

(71) Applicant: PANASONIC INTELLECTUAL PROPERTY MANAGEMENT CO., LTD., Osaka (JP)

(72) Inventor: Shigeyuki Ueda, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/323,454

(22) PCT Filed: Jun. 19, 2015

(86) PCT No.: PCT/JP2015/003073
§ 371 (c)(1),
(2) Date: Jan. 3, 2017

(87) PCT Pub. No.: WO2016/006172
PCT Pub. Date: Jan. 14, 2016

(65) Prior Publication Data

US 2017/0143116 A1 May 25, 2017

(30) Foreign Application Priority Data

Jul. 9, 2014 (JP) ..... 2014-141616

(51) Int. Cl.
*A47B 57/04* (2006.01)
*A47B 49/00* (2006.01)
(Continued)

(52) U.S. Cl.
CPC ..... *A47B 57/04* (2013.01); *A47B 49/002* (2013.01); *A47B 57/08* (2013.01); *A47B 61/04* (2013.01)

(58) Field of Classification Search
CPC ..... A47B 57/04; A47B 49/002; A47B 61/04; A47B 57/08; A47B 96/00; A47B 96/025;
(Continued)

(56) References Cited

U.S. PATENT DOCUMENTS 2,967,081 A * 1/1961 Kleinpenning ..... A47B 61/00 186/26
3,237,907 A * 3/1966 Dall ..... B60N 2/06 248/397
(Continued)

FOREIGN PATENT DOCUMENTS

JP 10-5055 1/1998

OTHER PUBLICATIONS

International Search Report, along with English-language translation thereof, in PCT/JP2015/003073 dated Aug. 11, 2015.

*Primary Examiner* — Korie H Chan
(74) *Attorney, Agent, or Firm* — Greenblum & Bernstein, P.L.C.

(57) ABSTRACT

A storage device includes, in a box having an open front, a rotation mechanism section that rotatably holds a storage body that stores an object and is rotatable about a shaft extending along an up-down direction. The rotation mechanism section includes: a stationary rail affixed to a top surface of the box and including a guide groove open downward and forward and extending in a front-back direction and a guide body on a holding section protruding downward from a groove bottom surface of the guide groove; and a movable rail movable in the front-back direction along the guide groove in the stationary rail, coupled to the storage body via the shaft, and including: left and right sidewalls, a bottom wall, and a front end wall that
(Continued)

define a receiving groove for receiving the guide body; and a top wall that forms a slit opening for receiving the holding section.

4 Claims, 6 Drawing Sheets

(51) Int. Cl.
*A47B 61/04* (2006.01)
*A47B 57/08* (2006.01)

(58) Field of Classification Search
CPC ..... A47B 61/00; A47B 61/003; B60N 2/06; B60N 2/0705; B60N 2/0715; B60N 2/0717; B60N 2/072; A47F 3/08
USPC ..... 211/126.15; 16/97, 91, 87 R; 49/449
See application file for complete search history.

(56) References Cited

U.S. PATENT DOCUMENTS 4,401,033 A * 8/1983 Gerken ..... E05D 15/06 104/111
4,811,925 A * 3/1989 Fujita ..... B60N 2/0715 248/430
7,523,913 B2 * 4/2009 Mizuno ..... B60N 2/123 248/429
7,946,543 B2 * 5/2011 Cotter ..... A47B 61/00 211/1.53
8,511,487 B2 * 8/2013 Andersen ..... A47B 49/004 211/144
8,820,547 B2 * 9/2014 Hayashida ..... A47B 61/003 211/162
2012/0168596 A1 * 7/2012 Ishimoto ..... B60N 2/071 248/430

* cited by examiner

STORAGE DEVICE

TECHNICAL FIELD

The present invention relates to a storage device including a rotatable storage body that stores an object.

BACKGROUND ART

Conventionally, a rotation storage device including a rotation storage body, which rotates about a shaft extending along the up-down direction, in a box having an open front is known. With such a rotation storage device, in order to rotate the rotation storage body, it is necessary to secure a relatively large space between the back surface of the box and the rotation storage body.

For example, Patent Literature (PTL) 1 described below discloses a rotation storage device including, attached thereto, a stationary rail and an upper carrier. The stationary rail has a substantially U-shaped cross section, extends in the front-back direction, and is attached to the bottom surface of a top plate of an outer case that rotatably houses shelves. The upper carrier is slidably held by the stationary rail and attached to the top surface of the outer case. Moreover, this rotation storage device includes a guide roller, which rotates about a vertical axis, provided to the stationary rail, and the upper carrier servers as a movable rail guided by the guide roller and having a guide side wall protruding into a substantially U-shaped cross section.

CITATION LIST

Patent Literature

PTL 1: Japanese Unexamined Patent Application Publication No. H10-5055.

SUMMARY OF THE INVENTION

Technical Problem

However, in the rotation storage device described in the above-mentioned PTL 1, since the movable rail has a groove shape opened forward and upward, the guide roller, for example, is easily noticeable and foreign matter or the like easily enters the movable rail. For these reason, further improvements are desired.

The present invention was conceived in view of the above circumstance, and has an object to provide a storage device capable of efficiently reducing the depthwise dimension of the box to a small dimension, and reducing the infiltration of, for example, foreign matter, into the movable rail of the top rotation mechanism section that rotatably holds the storage body.

Solution to Problem

In order to achieve the above described object, in one aspect of the present invention, a storage device includes, in a box having an open front, a rotation mechanism section that rotatably holds a storage body that stores an object. The storage body is rotatable about a shaft extending along an up-down direction. The rotation mechanism section includes a stationary rail affixed to a top surface of the box and a movable rail coupled to the storage body via the shaft. The stationary rail includes: a guide groove open downward and forward and extending in a front-back direction; and a guide body on a holding section protruding downward from a groove bottom surface of the guide groove. The movable rail is movable in the front-back direction along the guide groove in the stationary rail. The movable rail includes left and right sidewalls, a bottom wall, a front end wall, and a top wall. The left and right sidewalls, the bottom wall, and the front end wall define a receiving groove for receiving the guide body. The top wall forms a slit opening for receiving the holding section.

Advantageous Effects of Invention

It is possible to efficiently reduce the depthwise dimension of the box to a small dimension, and reduce the infiltration of, for example, foreign matter, into the movable rail of the top rotation mechanism section that rotatably holds the storage body.

DESCRIPTION OF EXEMPLARY EMBODIMENT

The following embodiment of the present invention will be explained on the basis of the drawings.

FIG. 1 through FIG. 6 schematically illustrate one example of the storage device according to this embodiment.

Note that specific reference marks shown in some of the figures are omitted from others.

Moreover, in the following embodiment, the front refers to the direction toward the foreground and the back refers to the opposite direction in reference to a view facing the opening of the installed storage device. In the same view, the up-down direction refers to the up and/or down directions, and the left-right direction refers to the left and/or right directions. Moreover, these directions are generally referred to under the assumption that the storage body of storage device is stored in the box, as illustrated in FIG. 4 through FIG. 6.

Figure 4:
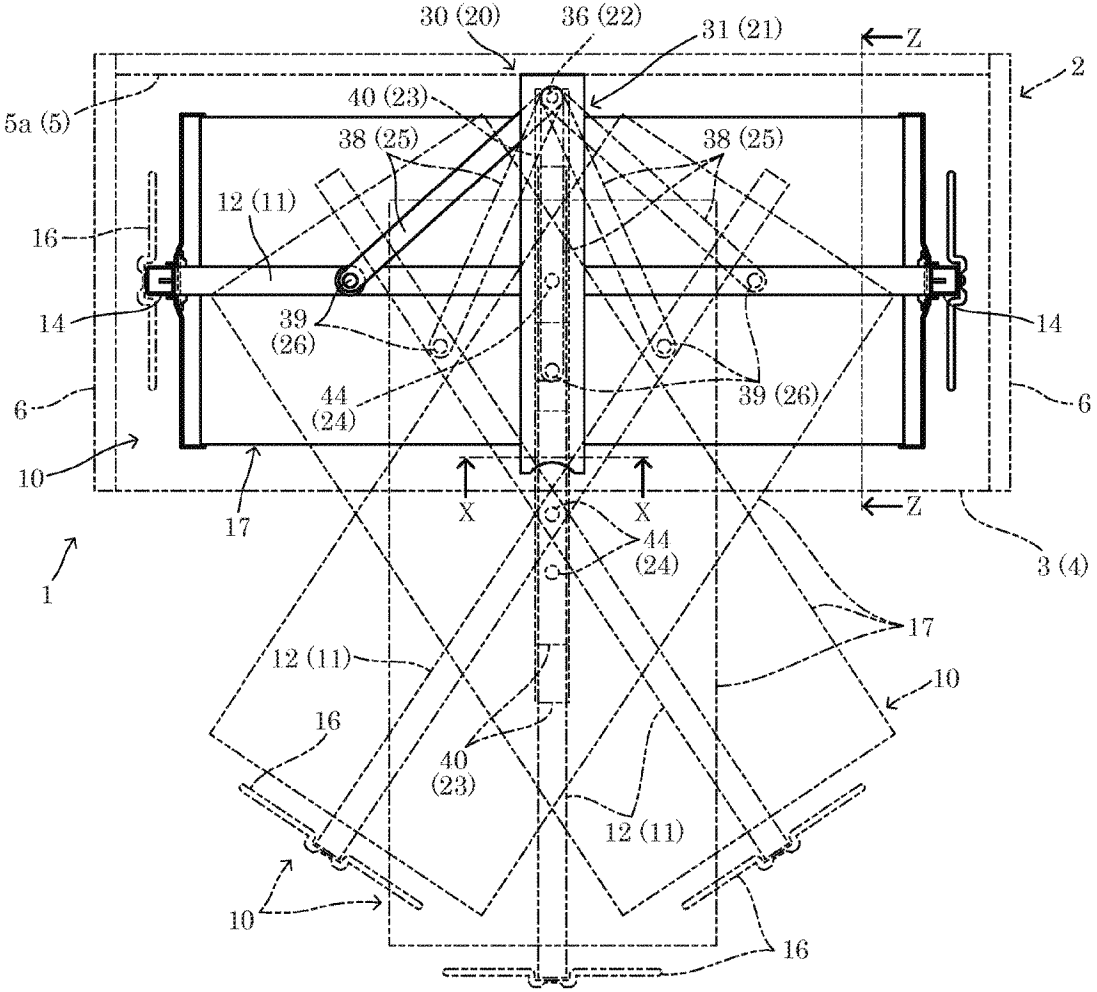
FIG. 4 is a partial schematic plan view of the storage device according to one embodiment of the present invention.
Figure 5:
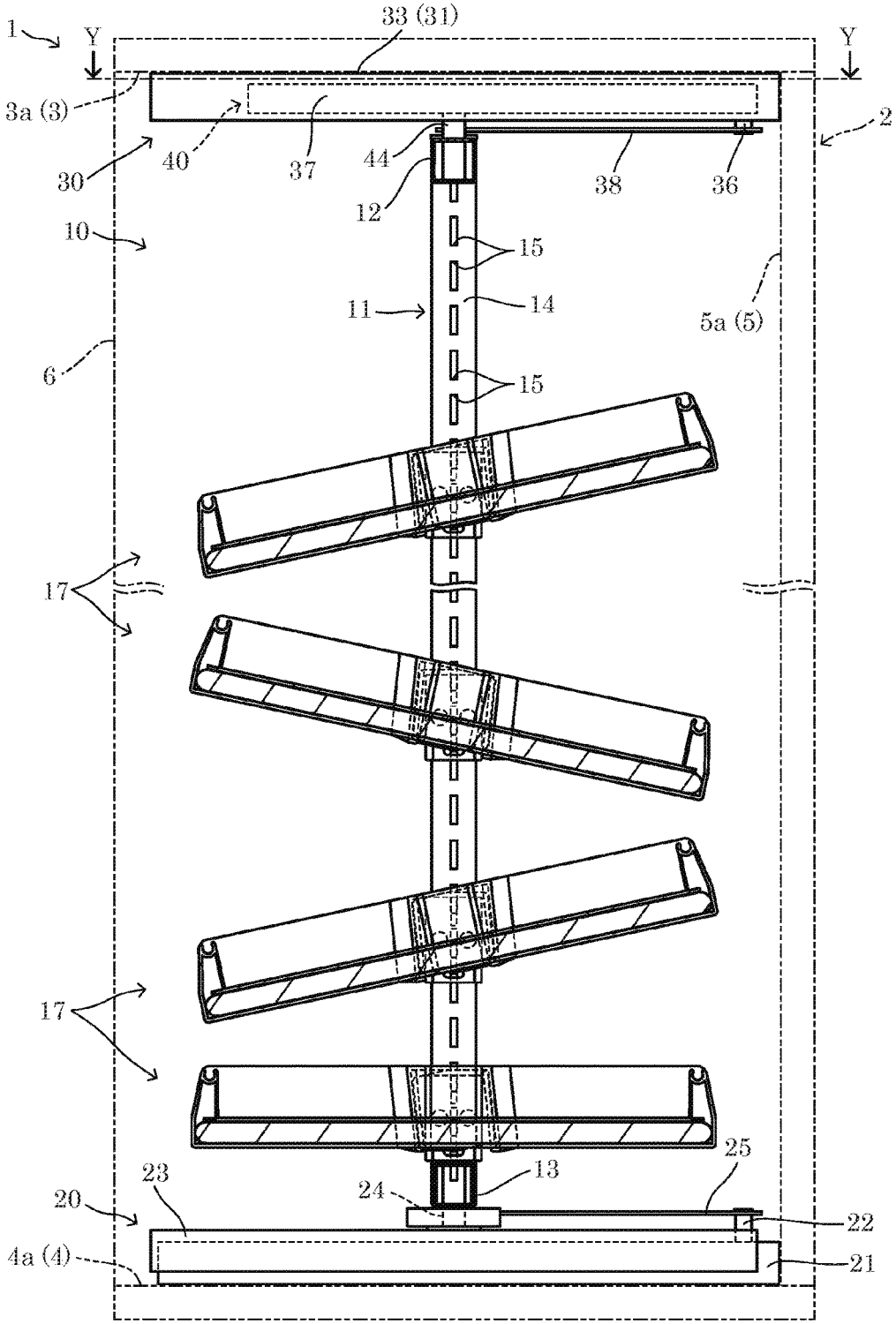
FIG. 5 is a partial schematic vertical cross section view taken along line Z-Z in FIG. 4, in the direction of the arrows.
Figure 6:
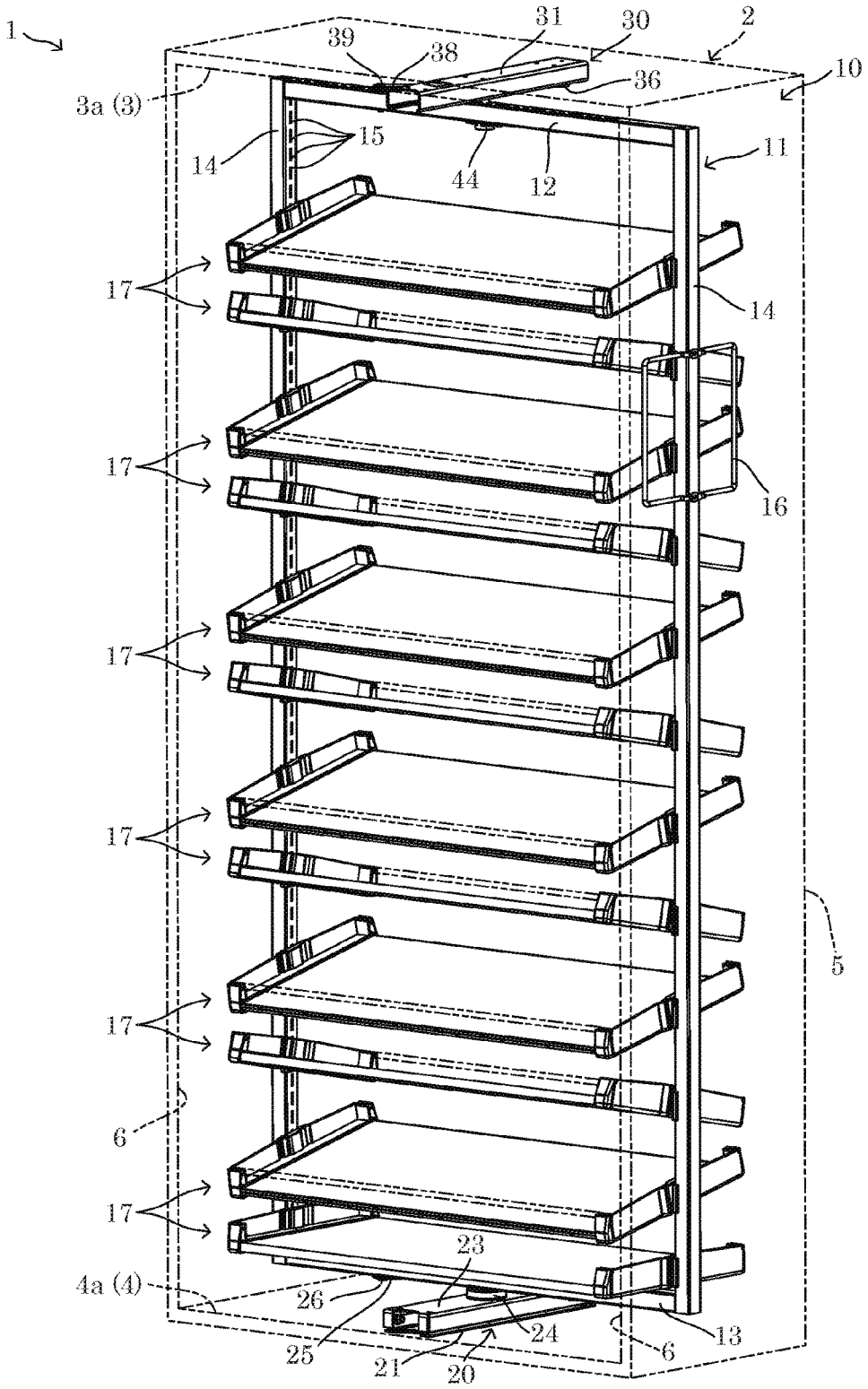
FIG. 6 is a partial schematic perspective view of the storage device according to one embodiment of the present invention.

As illustrated in FIG. 4 through FIG. 6, rotation storage device 1, which is a storage device according to this embodiment, includes a rotation mechanism section provided in box 2 having an open front. The rotation mechanism section rotatably holds rotation storage body 10, which is a storage body that stores an object. Rotation storage body 10 is rotatable about a shaft (rotational shaft 44) extending along the up-down direction. In this embodiment, in addition to top rotation mechanism section 30, which is a rotation mechanism section provided in the top portion of rotation storage body 10, rotation storage device 1 also includes bottom rotation mechanism section 20, which is provided in the bottom portion of rotation storage body 10 and rotatably holds rotation storage body 10 so as to be rotatable about rotational shaft 24 extending along the up-down direction.

Rotation storage device 1 may be an entrance hall storage device for storing, for example, shoes, suitably installed on the earthen floor or flooring of the entrance hall.

Box 2 has a substantially rectangular box-like shape in a front view in which the opening is facing forward. Box 2 includes top surface section 3, bottom surface section 4, back surface section 5, and left and right side surface sections 6, which collectively define the storage space in rotation storage body 10. The left-right dimension (storage opening dimension) of the storage space is greater than its front-back dimension (depthwise dimension).

Note that surface sections 3, 4, 5, and 6 may be boards. Moreover, box 2 may be made of, for example, a wooden material, metal material, or a composite resin material.

Moreover, box 2 may include a door that opens and closes the front opening of box 2. Moreover, the storage space of rotation storage body 10 may further include another storage space in, for example, the top or bottom portion thereof. In this case, the storage space may be divided into spaces stacked in the up-down direction, partitioned by horizontal boards, for example.

In this embodiment, rotation storage body 10 is disposed in box 2 and rotatable at least 180° about rotational shafts 24, 44, and includes frame body 11 which has a substantially rectangular frame-like shape in a front view, and a plurality of shelves 17. Rotation storage body 10 can be partitioned into a multi-level storage arranged in the up-down direction by installing disposing shelves 17 on frame body 11.

Frame body 11 includes top frame section 12, bottom frame section 13, and left and right upright frame sections 14.

As illustrated in FIG. 4 and FIG. 5, in a state in which rotation storage body 10 is housed in box 2, frame body 11 is disposed in the substantial center region in the front-rear direction of box 2.

Note that frame body 11 may be formed from a rigid material such as a metal material.

Top frame section 12 and bottom frame section 13 are elongated in the left-right direction.

The left and right upright frame sections (both side upright frame sections) 14 are elongated in the up-down direction.

Top frame section 12, bottom frame section 13, and left and right upright frame sections 14 are put together to form a substantially rectangular shape in a view along the lengthwise direction (in a horizontal cross section view), and, for example, are formed of a tubular component.

Top frame section 12 and bottom frame section 13 are arranged parallel to one another, and both side upright frame sections 14 are arranged parallel to one another.

Moreover, the lengthwise ends of top frame section 12 are fixed to the top ends of both side upright frame sections 14, and the lengthwise ends of bottom frame section 13 are fixed to the bottom ends of both side upright frame sections 14.

Note that top frame section 12, bottom frame section 13, and both side upright frame sections 14 may be formed integrally to form frame body 11, and, alternatively, the ends of frame sections 12, 13, and 14 may be appropriately coupled together by welding or with fasteners such as screws.

Moreover, handle 16 for sliding and rotating rotation storage body 10 is provided on one of the upright frame sections 14, midway in the lengthwise (up-down) direction.

As illustrated in FIG. 6, handle 16 has a substantially rectangular frame-like shape in a side view. Handle 16 is formed to have a greater front-back dimension than upright frame section 14. Moreover, handle 16 is fixed to upright frame section 14 in a substantially central section thereof in the front-rear direction so as to form a first grip that projects in one direction along the front-rear direction (forward) beyond upright frame section 14, and a second grip that projects in the other direction along the front-rear direction (rearward) beyond upright frame section 14. Note that handle 16 may be appropriately connected to upright frame section 14 by welding or with fasteners such as screws.

Moreover, a plurality of shelves 17 are provided (in the example illustrated in the drawings, 12 shelves 17 are provided) so as to span between both side upright frame sections 14 and be spaced apart in the up-down direction.

The widthwise ends of shelves 17 may be fixed with appropriate fixing components to both side upright frame sections 14, and, alternatively, may be removably attached to both side upright frame sections 14. In the example illustrated in the drawings, a plurality of insertion holes 15 are provided spaced from each other in the up-down direction in inner surfaces of both side upright frame sections 14 that face each other, as engaging holding sections that removably hold holding assemblies that hold the widthwise ends of shelves 17. This configuration makes it possible to change the number of shelves 17 used and the heights of shelves 17.

Moreover, in this embodiment, as illustrated in FIG. 5 and FIG. 6, shelves 17 are provided so as to incline to different sides alternately in order in the up-down direction, except for the lowermost shelf 17. The lowermost shelf 17 is held by both side upright frame sections 14 in a horizontal state so that its upper surface serving as an article mounting portion is horizontal. In addition, each shelf 17 above the lowermost shelf 17 is held by both side upright frame sections 14 in a state such that the inclination angle (inner angle) of the upper surfaces thereof are inclined at an angle between from, for example, about 5° to 30°—preferably about 10° to 20°—forward or backward, alternately in order in the up-down direction. By inclining shelves 17 in this manner, objects, such as shoes, can be efficiently stored.

In a state in which the plurality of shelves 17 are attached to frame body 11 in the manner described above, rotation storage body 10 functions as a storage space (storage) for storing an object, between the top surface of a bottom shelf 17 and the bottom surface of a top shelf 17 located above the bottom shelf 17. Moreover, the space between the uppermost shelf 17 and top frame section 12 is a storage space (storage) for storing an object.

Moreover, rotation storage body 10 is configured to allow for objects to be stored to be easily placed on and taken from the front of shelves 17 inclined forward. Moreover, in rotation storage body 10, the front end of a shelf 17 that is inclined rearward and the front end of shelf 17 directly above that is inclined forward are relatively close to each other, and as such, objects to be stored on the rearward inclined shelves 17 are difficult to be placed on and taken therefrom.

In other words, regarding the rearward inclined shelves 17, as previously described, by rotating rotation storage body 10 180° so as to incline forward, objects can be easily placed on and taken from the front.

With the above configuration, the storage space of rotation storage device 1 (rotation storage body 10) can be efficiently used. Note that even when shelves 17 are provided not inclined as described above, for example, when the front-rear dimension of the storage space is (shelves 17 are) relatively large, the ability to place and take objects can be improved by rotating rotation storage body 10.

Moreover, in the example illustrated in the drawings, shelves 17 include, on both ends of the flat, plate-like shelf main bodies, standing walls standing upright. Inclusion of such standing walls makes it possible to inhibit articles placed on shelves 17 from falling off the widthwise sides. Moreover, in the example illustrated in the drawings, receiving indentations are provided in the front and back end sections of the widthwise ends of shelves 17. The receiving indentations receive lengthwise ends of a bar for inhibiting objects from falling, extending across the widthwise length of the respective shelf 17. With this configuration, as illustrated in FIG. 6, bars for inhibiting objects from falling can be optionally attached to one or both depthwise ends of shelves 17.

Note that the arrangement of each of shelves 17 described above is merely one example. For example, a number of tiers of shelves 17 arranged in the up-down direction in which all shelves 17 are inclined forward, rearward, or arranged horizontal is possible. Moreover, shelves 17 may be made of, for example, a wooden material, metal material, or a composite resin material.

Rotation storage body 10 including shelves 17 in the manner described above is rotatably held so as to be rotatable about rotational shafts 44, 24, which extend along the up-down direction, relative to box 2 via rotation mechanism sections 30, 20 provided on the top and bottom of rotation storage body 10.

As illustrated in FIG. 5, the top and bottom rotation mechanism sections 30, 20 are provided in a total of two locations. Top rotation mechanism section 30 is provided between top surface 3*a* of box 2 and the top of rotation storage body 10, and bottom rotation mechanism section 20 is provided between bottom surface 4*a* of box 2 and the bottom of rotation storage body 10. Top and bottom rotation mechanism sections 30, 20 are disposed so as to substantially overlap in a plan view, and both operate largely in the same manner. Moreover, the top and bottom rotation mechanism sections 30, 20 are disposed in the substantial central region in the left-right direction (storage opening direction) of the storage space of box 2.

As illustrated in FIG. 5, bottom rotation mechanism section 20 includes stationary rail 21 elongated along the front-rear direction (depthwise direction), and movable rail 23 coupled to rotation storage body 10 via rotational shaft 24, which is slidable in the front-rear direction along stationary rail 21. Bottom rotation mechanism section 20 further includes guide arm 25 that guides movement of rotation storage body 10 that moves in the front-rear direction while rotating about rotational shaft 24 relative to movable rail 23 (see also FIG. 4).

Although detailed depiction is omitted from the drawings, stationary rail 21 and movable rail 23 are provided with guide grooves that extend in the front-rear direction and guide rollers that move along and are guided by these guide grooves.

Stationary rail 21 is fixed to bottom surface 4*a* of box 2 while the back end of stationary rail 21 is close to or abutting back surface 5*a*. Moreover, in the example illustrated in the drawings, the depthwise dimension (length) of stationary rail 21 is exemplified as being smaller than the depthwise dimension of box 2 so as to position the front end of stationary rail 21 in a location farther back than the front edge of box 2.

Moreover, coupling shaft 22 serves as the center of rotation of one lengthwise end (the rear lengthwise end) of guide arm 25. Coupling shaft 22 is provided such that its axial direction extends along the up-down direction and that it protrudes upward from the rear end of stationary rail 21. Note that the rear end of movable rail 23 is provided with a rearward opening notch that receives coupling shaft 22.

As illustrated in FIG. 6, the other lengthwise end (the front lengthwise end) of guide arm 25 is rotatably coupled to coupling shaft 26 so as to be rotatable about coupling shaft 26 relative to rotation storage body 10. In this embodiment, the front end of guide arm 25 is connected to rotation storage body 10 so as to be in substantially the same front-rear direction position as rotational shaft 24 in a state in which rotation storage body 10 is housed in box 2.

Coupling shaft 26 serving as the center of rotation for the front end of guide arm 25 is provided on bottom frame section 13 of rotation storage body 10, offset to the other of the left and right upright frame sections 14 (the one to which handle 16 is not provided) sides, so as to protrude downward and have an axial direction that extends along the up-down direction. In the example illustrated in the drawings, coupling shaft 26 is disposed in the approximate lengthwise middle of the half of bottom frame section 13 on the other of the left and right upright frame sections 14 side (also see FIG. 4).

Guide arm 25, which is rotatably coupled at its lengthwise ends as described above so as to be rotatable with respect to stationary rail 21 and rotation storage body 10, rotates in a range of about 90° about coupling shaft 22 located at the rear end of stationary rail 21, such that its front end moves in the left-right direction (see FIG. 4). Moreover, guide arm 25 is disposed such that its lengthwise direction extends along the front-rear direction when movable rail 23 is in its foremost position, and from this state, can rotate about 45° to both left and right sides.

Movable rail 23 is slidable forward relative to stationary rail 21, such that its front end protrudes farther forward than the front end of stationary rail 21.

Rotational shaft 24 is provided as a shaft midway in the lengthwise (front-back) direction of movable rail 23, whose axial direction extends along the up-down direction and which serves as the center of rotation for rotation storage body 10. Rotational shaft 24 is provided so as to be disposed in the approximate center of the storage space of box 2 in a plan view when movable rail 23 is in its rearmost position. In the example illustrated in the drawings, rotational shaft 24 is provided in the approximate center in the lengthwise direction of movable rail 23.

Moreover, rotational shaft 24 is provided such that rotation storage body 10 is rotatable about rotational shaft 24, relative to movable rail 23. Rotational shaft 24 is provided so as to be located in the approximate center in the lengthwise direction of bottom frame section 13. For example, a configuration in which rotational shaft 24 is fixed relative to bottom frame section 13 of frame body 11 of rotation storage body 10, and a shaft receiving section that rotatably holds rotational shaft 24 is provided on movable rail 23 may be used. Moreover, rotational shaft 24 may be fixed to the movable rail 23 side and may be rotatable relative to rotation storage body 10.

Top rotation mechanism section 30 includes stationary rail 31 including guide groove 32 that opens downward and forward and extends in the front-rear direction, and movable rail 40 that is movable in the front-rear direction along guide groove 32 of stationary rail 31 and coupled to rotation storage body 10 via shaft 44. Similar to bottom rotation mechanism section 20, top rotation mechanism section 30 further includes guide arm 38 that guides movement of rotation storage body 10 that moves in the front-rear direction while rotating about shaft 44 relative to movable rail 40.

Stationary rail 31 is fixed to bottom surface 3*a* of box 2 while the back end of stationary rail 31 is close to or abutting back surface 5*a* of box 2. Moreover, in the example illustrated in the drawings, similar to bottom rotation mechanism section 20, the depthwise dimension (length) of stationary rail 31 is exemplified as being smaller than the depthwise dimension of box 2 so as to position the front end of stationary rail 31 in a location farther back than the front edge of box 2.

Figure 1:
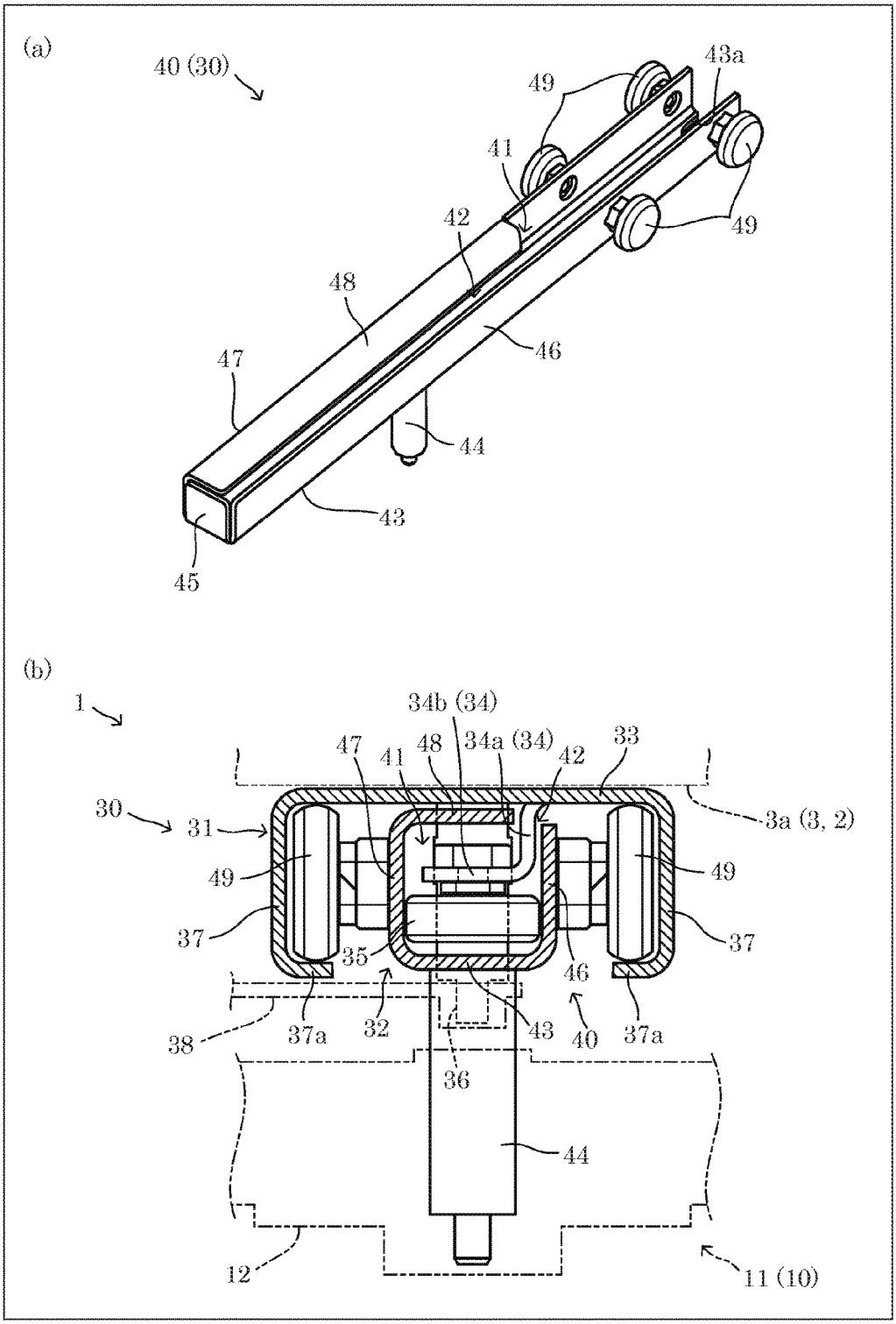
FIGS. 1 (*a*) and (*b*) in FIG. 1 schematically illustrate one example of the storage device according to one embodiment of the present invention, where (a) illustrates a schematic perspective view of one example of the movable rail of the rotation mechanism section included in the storage device according to one embodiment of the present invention, and (b) illustrates a partial schematic vertical cross section view taken along line X-X in FIG. 4, in the direction of the arrows.

As illustrated in (b) in FIG. 1, stationary rail 31 forms the groove bottom surface of guide groove 32, and includes top wall 33 that is fixed to top surface 3*a* of box 2 and left and right sidewalls 37 that are provided to hang down from the left and right end portions of top wall 33 so as to form the left and right side surfaces of guide groove 32. Guide ledges 37*a* are provided on the bottom ends of both left and right sidewalls 37, and extend along the entire length of both left and right sidewalls 37 so as to protrude toward one another (see also FIG. 2).

Moreover, stationary rail 31 includes guide body 35 on holding section 34 that protrudes downward from the groove bottom surface of guide groove 32. Holding section 34 and guide body 35 are provided on the front end portion of stationary rail 31.

Moreover, in this embodiment, holding section 34 includes insertion tongue part 34*a* whose thickness direction extends along the left-right direction (the widthwise direction of guide groove 32). Moreover, in this embodiment, holding section 34 is cut and raised from top wall 33 defining the groove bottom surface of stationary rail 31.

Figure 2:
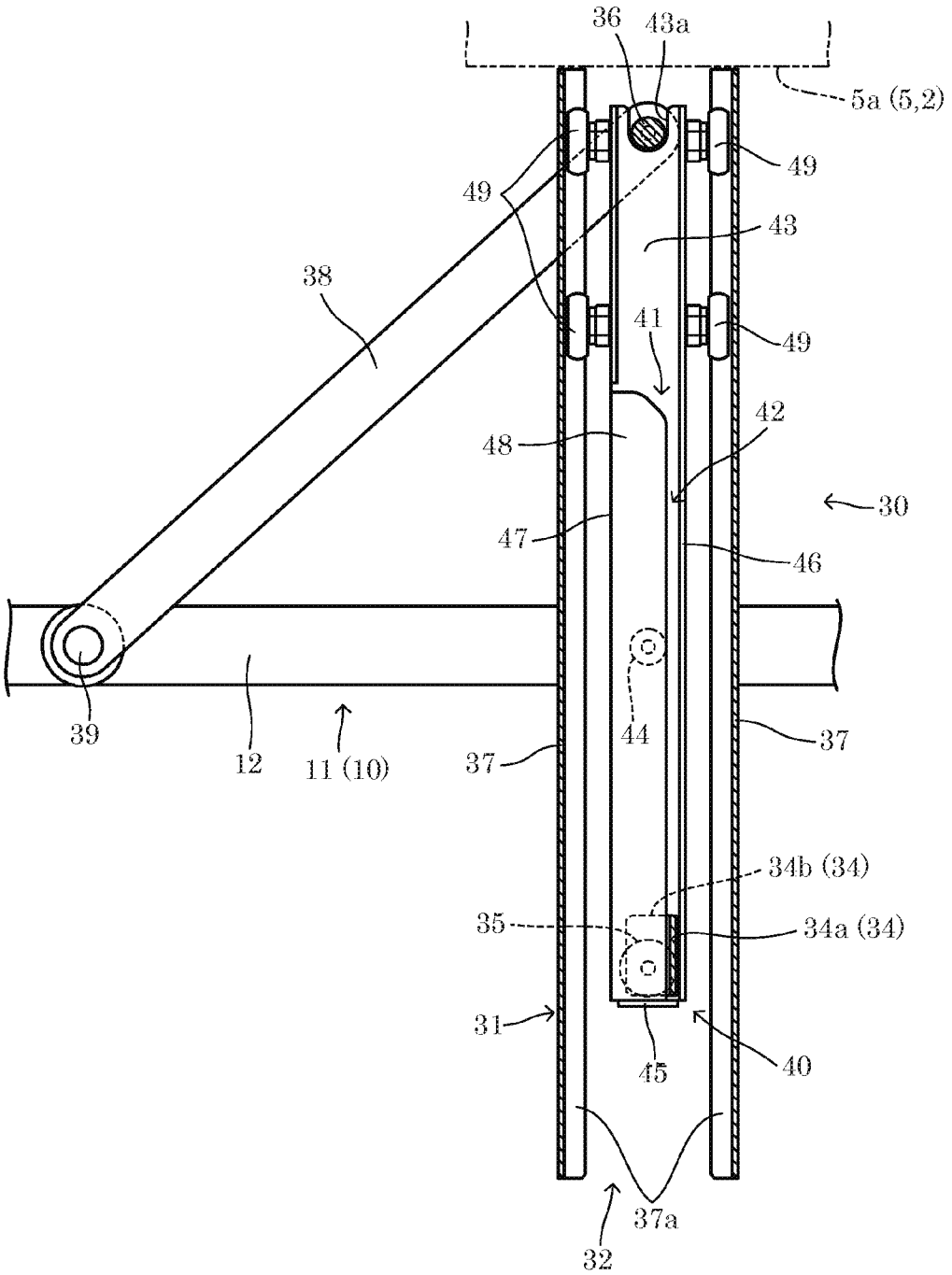
FIG. 2 is a partial schematic horizontal cross section view taken along line Y-Y in FIG. 5, in the direction of the arrows.

Moreover, as illustrated in (b) in FIG. 1 and FIG. 2, holding section 34 integrally includes holding part 34*b* that holds guide body 35, provided on the bottom end of insertion tongue part 34*a* provided so as to hang down from top wall 33. Holding part 34*b* is provided such that its thickness direction extends along the up-down direction and provided so as to protrude along the widthwise direction of the groove, from the bottom end of insertion tongue part 34*a*. In this embodiment, insertion tongue part 34*a* is provided to one side of the widthwise center of guide groove 32 such that holding part 34 is disposed in the approximate widthwise center of guide groove 32. Insertion tongue part 34*a* and holding part 34*b* are formed by punching top wall 33 and appropriately bending top wall 33, and, for example, have a thin plate-like shape (see also FIG. 3).

Guide body 35 is held by holding part 34*b* so as to be positioned in the approximate widthwise center of guide groove 32.

In this embodiment, guide body 35 serves as guide roller 35 which is rotatable around a shaft that extends along the up-down direction. Guide roller 35 is disposed below holding part 34*b*, and appropriately rotatably held by holding part 34*b* via, for example, a coupling shaft.

Note that guide body 35 is not limited to guide roller 35 described above; guide body 35 may be block-shaped guide block, for example, or another one of various other structures.

Moreover, coupling shaft 36 is provided on the rear end of stationary rail 31, and serves as the center of rotation of one lengthwise end (the rear lengthwise end) of guide arm 38. Coupling shaft 36 is provided such that its axial direction extends along the up-down direction and that it protrudes downward from the rear end of top wall 33 of stationary rail 31. As illustrated in (b) in FIG. 1 and FIG. 2, coupling shaft 36 is provided in the approximate widthwise center of guide groove 32.

Moreover, coupling shaft 36 is provided so as to be coaxial with coupling shaft 22 provided on stationary rail 21 of bottom rotation mechanism section 20, as described above (see FIG. 4).

As illustrated in FIG. 2, substantially similar to the bottom guide arm 25, the other lengthwise end (the front lengthwise end) of guide arm 38 is rotatably coupled to coupling shaft 39 so as to be rotatable about coupling shaft 39 relative to rotation storage body 10. Moreover, as described above, the front end of guide arm 38 is connected to rotation storage body 10 so as to be in substantially the same front-rear direction position as rotational shaft 44 in a state in which rotation storage body 10 is housed in box 2.

Coupling shaft 39 serving as the center of rotation for the front end of guide arm 38 is provided so as to be coaxial with coupling shaft 26 on the front end of the bottom guide arm 25 (see FIG. 4). In other words, coupling shaft 39 on the front end of guide arm 38 is provided on top frame section 12 of rotation storage body 10, offset to the other of the left and right upright frame sections 14 (the one to which handle 16 is not provided) sides, so as to protrude upward and have an axial direction that extends along the up-down direction. In the example illustrated in the drawings, coupling shaft 39 is disposed in the approximate lengthwise middle of the half of top frame section 12 on the other of the left and right upright frame sections 14 side (also see FIG. 4).

Similar to the bottom guide arm 25, the top guide arm 38 rotates in a range of about 90° about coupling shaft 36 located at the rear end of stationary rail 31, such that its front end moves in the left-right direction about (see FIG. 4). Moreover, guide arm 38 is disposed such that its lengthwise direction extends along the front-rear direction when movable rail 40 is in its foremost position, and from this state, can rotate about 45° to both left and right sides.

In other words, guide arms 38, 25 of top and bottom rotation mechanism sections 30, 20 substantially overlap one another in a plan view, and substantially maintain this overlapping state while rotating. Note that a configuration in which a guide arm is provided to only one of the top and bottom rotation mechanism sections 30, 20 is also acceptable.

As illustrated in FIG. 1 and FIG. 2, movable rail 40 includes receiving groove 41 that receives guide roller 35 serving as the guide body. Receiving groove 41 is provided so as to extend in the front-rear direction. Moreover, movable rail 40 includes left and right sidewalls 46, 47, bottom wall 43, and front end wall 45 which define receiving groove 41, and top wall 48 forming slit opening 42 for receiving holding section 34.

Figure 3:
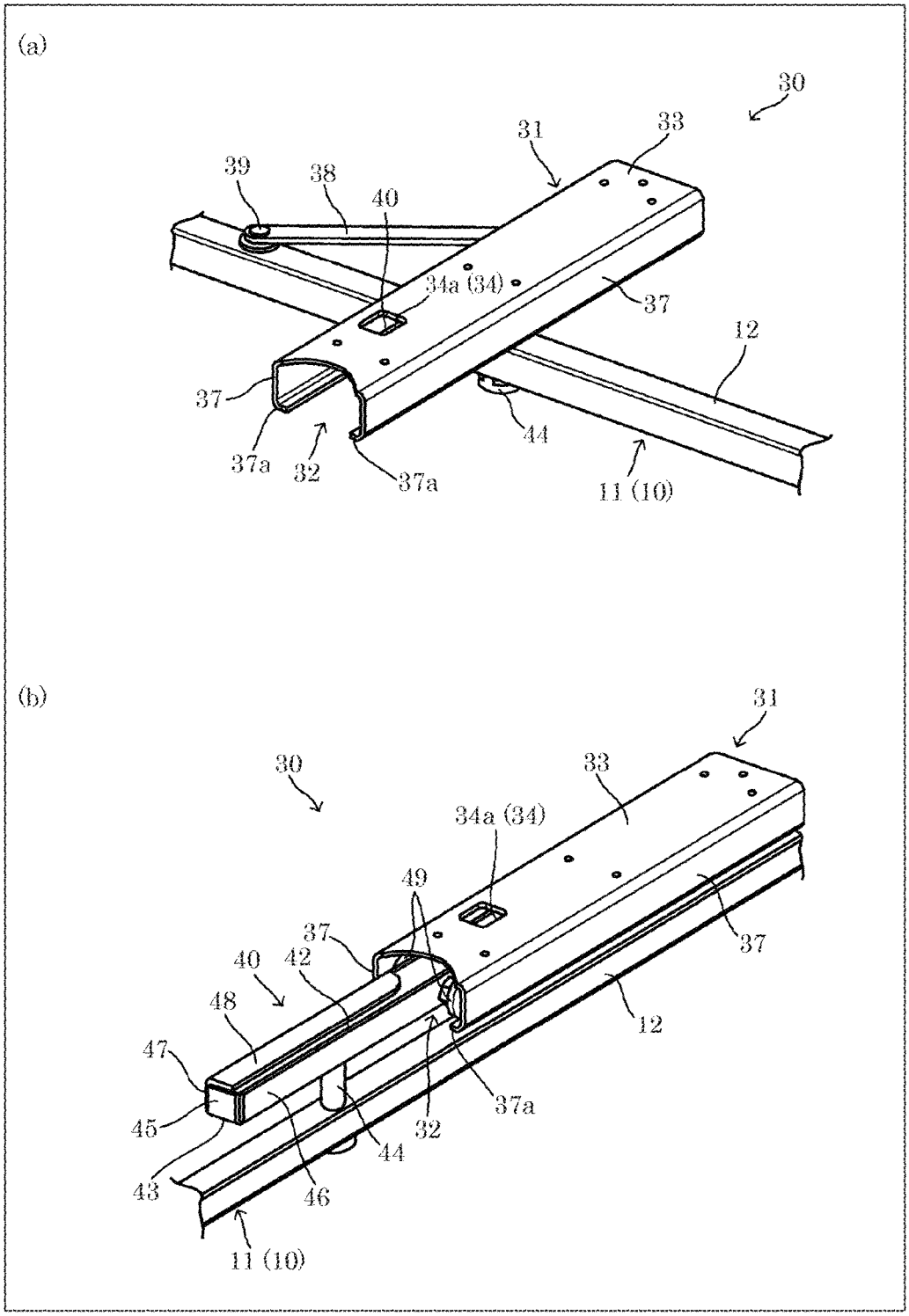
FIGS. 3 (*a*) and (*b*) in FIG. 3 are partial schematic perspective views of the rotation mechanism section according to one embodiment of the present invention.

Moreover, as illustrated in FIG. 3, similar to bottom rotation mechanism section 20, movable rail 40 is slidable forward relative to stationary rail 31, such that its front end protrudes farther forward than the front end of stationary rail 31.

Rotational shaft 44 is provided as a shaft midway in the lengthwise (front-back) direction of movable rail 40, whose axial direction extends along the up-down direction and which serves as the center of rotation for rotation storage body 10. Rotational shaft 44 is provided so as to be coaxial with coupling shaft 22 provided on stationary rail 21 of bottom rotation mechanism section 20, as described above (see FIG. 4). In other words, rotational shaft 44 is provided so as to be disposed in the approximate center of the storage space of box 2 in a plan view when movable rail 40 is in its rearmost position.

Similar to described above, rotational shaft 44 is provided such that rotation storage body 10 is rotatable about rotational shaft 44, relative to movable rail 40.

Moreover, rotational shaft 44 is fixedly provided so as to protrude downward from the bottom surface of bottom wall 43 of movable rail 40. Rotational shaft 44 is rotatably coupled relative to top frame section 12 so as to be positioned in the approximate longitudinal center of top frame section 12, and includes shaft receiving section that rotatably holds rotational shaft 44 on the top frame section 12 side. Note that as an alternative to this configuration, rotational shaft 44 may be fixed to the top frame section 12 side and may be rotatable relative to movable rail 40.

Bottom wall 43 defining the groove bottom surface of receiving groove 41 of movable rail 40 is provided across the entire length of movable rail 40. In this embodiment, movable rail 40 is housed in guide groove 32 of stationary rail 31 such that the bottom surface of bottom wall 43 is positioned above the bottom surface of stationary rail 31. In other words, as illustrated in (b) in FIG. 1, the entirety of movable rail 40 excluding rotational shaft 44 is housed in guide groove 32 of stationary rail 31 in a view along the lengthwise direction.

Moreover, as illustrated in FIG. 2, the rear end of bottom wall 43 is provided with a rearward opening notch 43*a* that receives coupling shaft 36 provided on the rear end of stationary rail 31. In a state in which movable rail 40 is in its rearmost position, coupling shaft 36 fits in notch 43*a*.

Sidewalls 46, 47, which form the left and right side surfaces of receiving groove 41 of movable rail 40, are provided across the entire length of movable rail 40 so as to stand upright from both left and right ends of bottom wall 43. The inner surfaces of sidewalls 46, 47 that face each other form the inner side surfaces of the grove, and guide roller 35 of stationary rail 31 abuts the inner surface of sidewalls 46, 37 and rotates. The dimensions of sidewalls 46, 47—that is to say, the widthwise dimension of receiving groove 41—is determined according to the diameter of guide roller 35.

As illustrated in FIG. 2, movable rail 40 has an appropriate lengthwise dimension such that when movable rail 40 is in its rearmost position, guide roller 35 is positioned at the front end of receiving groove 41, and when movable rail 40 is in its foremost position, guide roller 35 is positioned at the rear end of receiving groove 41. In other words, guide roller 35 is always in receiving groove 41 when movable rail 40 moves in the front-rear direction relative to stationary rail 31.

Moreover, in this embodiment, as illustrated in (b) in FIG. 1, rollers 49 are provided to sidewalls 46, 47, as components to be guided in an engaging manner by guide ledges 37*a* on both sides of stationary rail 31. Rollers 49 are rotatable about a shaft whose axial direction matches the widthwise direction of guide groove 32, and which roll on top of guide ledges 37*a* of stationary rail 31. Note that rollers 49 may abut and roll on top of the bottom surface of top wall 33 of stationary rail 31—that is to say, on the groove bottom surface of guide groove 32.

Moreover, in this embodiment, as illustrated in (a) in FIG. 1 and FIG. 2, rollers 49 are provided in the rear end of movable rail 40. As illustrated in FIG. 2, rollers 49 are positioned at the rear end of stationary rail 31 when movable rail 40 is in its rearmost position, and positioned at the front end of stationary rail 31 when movable rail 40 is in its foremost position (see also (b) in FIG. 3). In other words, rollers 49 are always in guide groove 32 when movable rail 40 moves in the front-rear direction relative to stationary rail 31.

The dimension along the up-down direction from top wall 33 of stationary rail 31 to guide ledges 37*a* (depthwise dimension of guide groove 32) is a dimension capable of housing rollers 49. In the example illustrated in the drawings, the dimension along the up-down direction from top wall 33 of stationary rail 31 to guide ledges 37*a* is a dimension dependent on the diameter of rollers 49.

Moreover, the dimension between sidewalls 37 of stationary rail 31—that is to say, the widthwise dimension of guide groove 32—is such that the left and right outer surfaces of rollers 49 on both sides of movable rail 40 are near the inner surfaces of sidewalls 37 that face each other.

Moreover, in this embodiment, a plurality of pairs (two in the example illustrated in the drawings) of rollers 49 (a total of four) are provided on sidewalls 46, 47, space apart from one another in the front-rear direction.

Front end wall 45 is provided to seal the front end of receiving groove 41, and provided such that its four sides are near or abut bottom wall 43, sidewalls 46, 47, and top wall 48. In the example illustrated in the drawings, front end wall 45 is continuous with bottom wall 43 and bent upward from the front end of bottom wall 43.

In this embodiment, top wall 48 is provided to define the top surface of receiving groove 41 so as to form slit opening 42 into which insertion tongue part 34*a* of holding section 34 inserts.

Moreover, in this embodiment, movable rail 40 has a structure in which slit opening 42 is the space between one of the left and right ends of top wall 48 and one top end of a first of the left and right sidewalls 46. In other words, one end of top wall 48 and the top end of the first sidewall 46 define both widthwise side ends of slit opening 42.

Slit opening 42 is provided so as to extend in the front-rear direction and penetrate through in the up-down direction, and provided across the entire length of top wall 48 along one of the left and right edges of top wall 48. As illustrated in (b) in FIG. 1 and FIG. 2, the widthwise dimension of slit opening 42 (dimension along the widthwise dimension of receiving groove 41) is a dimension that allows for slit opening 42 to received insertion tongue part 34*a* of holding section 34 described above, and is a dimension determined in accordance with the thickness dimension of insertion tongue part 34*a*.

Moreover, in this embodiment, top wall 48 is continuous with the top edge of the other sidewall 47. Top wall 48 is provided so as to protrude from the top edge of the second sidewall 47 toward the first sidewall 46, and is provided such that its thickness direction extends along the up-down direction.

Moreover, in this embodiment, top wall 48 is not provided across the entire length of movable rail 40, but rather is provided from front end wall 45 toward the rear end, but terminates before reaching the rear end. In the example illustrated in the drawings, top wall 48 is provided such that its rear end terminates just in front of the pair of rollers 49 located on both sides at the rear end of movable rail 40. This configuration improves workability with respect to installing rollers 49.

Top wall 48 may be provided such that, when movable rail 40 is in its foremost position, the rear end of top wall 48 is located approximately in the same front-rear direction as the front end of box 2 or stationary rail 31, and may be provided such that the rear end of top wall 48 is located closer to the rear end than the front end of box 2 or stationary rail 31. Note that as an alternative configuration, top wall 48 may be provided across the entire length of movable rail 40.

With the above described configuration, rotational shafts 44, 24 of top and bottom rotation mechanism sections 30, 20 are movable forward and backward by sliding movable rails 40, 23 forward and backward along stationary rail 31, 21, respectively. In other words, when movable rails 40, 23 are slid forward, rotational shafts 44, 24 of rotation storage body 10 move forward, and when movable rails 40, 23 are slid back, rotational shafts 44, 24 of rotation storage body 10 move back. Moreover, with this configuration, frame body 11 (rotation storage body 10) is slidable forward from box 2 via movable rails 40, 23, and rotatable about rotational shafts 44, 24 relative to movable rails 40, 23. With this, by sliding rotational shafts 44, 24, which are the center of rotation for rotation storage body 10, forward, a space forms between back surface 5*a* of box 2 for rotation storage body 10 to rotate, and using this space, rotation storage body 10 can be rotated about rotational shafts 44, 24.

Moreover, by providing guide arms 38, 25 as described above, the range of rotation of frame body 11 (rotation storage body 10) (the range of rotational movement) about rotational shafts 44, 24 is restricted. With this, as illustrated in FIG. 4, rotation storage body 10 can rotate in a range of about 180° about rotational shafts 44, 24 while sliding in the front-rear direction relative to box 2. Moreover, with this, rotation storage body 10 can turn around front and back (can rotate 180°) and be stored in these two states in box 2. In other words, with rotation storage device 1, rotation storage body 10 can be rotated about rotational shafts 44, 24 while sliding rotational shafts 44, 24 in the front-rear direction to invert (switch) the front and back of rotation storage body 10.

Note that a biasing mechanism may be provided to top and bottom rotation mechanism sections 30, 20 that bias, toward the storage side, movable rails 40, 23, which protrude forward relative to stationary rails 31, 21.

Moreover, top and bottom rotation mechanism sections 30, 20 may be made of, for example, a metal material or a composite resin material.

By having the configuration described above, storage device (rotation storage device) 1 according to this embodiment is capable of efficiently reducing the depthwise dimension of box 2 to a small dimension, and reducing the infiltration of, for example, foreign matter, into movable rail 40 of the top rotation mechanism section 30 serving as the rotation mechanism section.

In other words, storage body (rotation storage body) 10 that stores objects has a configuration in which top rotation mechanism section 30, which rotatably holds storage body 10 so as to be rotatable about rotational shaft 44, which extends along the up-down direction, is provided in box 2 that opens to the front. Therefore, as described above, rotation storage body 10 can efficiently store objects, and by rotating rotation storage body 10, objects can be easily taken from and placed in rotation storage body 10.

Moreover, top rotation mechanism section 30 includes movable rail 40 that is movable in the front-rear direction along guide groove 32 extending in the front-rear direction of stationary rail 31 fixed to top surface 3*a* of box 2, and is coupled to rotation storage body 10 via rotational shaft 44. Therefore, rotation storage body 10 can be rotated as rotational shaft 44 of rotation storage body 10 is moved in the front-rear direction relative to box 2. With this, when rotating rotation storage body 10, rotation storage body 10 can be kept from protruding farther rearward than when rotation storage body 10 is housed in box 2. In other words, the space required for rotation of rotation storage body 10 necessary in the rear of rotation storage body 10 while housed in box 2 can be reduced, and the depthwise dimension of box 2 can be efficiently reduced while securing depthwise dimension of the storage space in rotation storage body 10.

Moreover, movable rail 40 includes sidewalls 46, 47, bottom wall 43, and front end wall 45 that define receiving groove 41 that receives guide body (guide roller) 35 provided to stationary rail 31. Movable rail 40 also includes top wall 48 that forms slit opening 42 that receives holding section 34 that holds guide body 35. Therefore, guide body 35 housed inside receiving groove 41 of movable rail 40 is less noticeable. Further, foreign matter, for example, can be kept from infiltrating into movable rail 40 even further. Moreover, guide body 35 of stationary rail 31 guides the sliding of movable rail 40, whereby side to side movement of movable rail 40 can be reduced. In other words, guiding movable rail 40 with guide body 35 provided to stationary rail 31 is possible and reducing exposure in receiving groove 41 of movable rail 40 is possible. Note that guide body 35 is not limited to reducing side to side movement of movable rail 40; guide body 35 may also reduce movement in the up-down direction. In this case, rollers 49 serving as the components to be guided toward the rear end of movable rail 40 described above may also server to reduce side to side movement of movable rail 40. The mechanism that guides the sliding of movable rail 40 relative to stationary rail 31 may assume various embodiments.

Moreover, in this embodiment, movable rail 40 has a structure in which slit opening 42 is the space between one of the left and right ends of top wall 48 and one top end of the first sidewall 46 among the left and right sidewalls. Therefore, for example, compared to top walls that protrude from the two top ends of the left and right sidewalls 46, 47 in converging directions and a slit opening formed between the two top walls, it is possible to more effectively form slit opening 42. In other words, it is possible to form top wall 48 and slit opening 42 by extending a portion of the second sidewall 47 to become top wall 48 and bending the extended portion. Moreover, since slit opening 42 is provided along the first sidewall 46 of movable rail 40, it is possible to effectively reduce foreign matter, for example, from contacting guide body 35. Note that, as an alternative to this example, a configuration in which top walls that protrude from the two top ends of the left and right sidewalls 46, 47 in converging directions and a slit opening is formed between the two top walls is acceptable. In this case, insertion tongue part 34*a* or holding parts 34*b* of holding section 34, for example, may be modified as required.

Moreover, in this embodiment, holding section 34 includes insertion tongue part 34*a* whose thickness direction extends along the left-right direction and that inserts into slit opening 42. Therefore, for example, compared to when holding section 34 is a vertical shaft-like component, the widthwise dimension of slit opening 42 of movable rail 40 can be effectively reduced, and infiltration of foreign matter, for example, in to movable rail 40 can be effectively reduced.

Moreover, in this embodiment, holding section 34 is cut and raised from top wall 33 defining the groove bottom surface of stationary rail 31. Therefore, for example, compared to a configuration in which holding section 34 is attached to top wall 33 of stationary rail 31, holding section 34 can be provided more effectively. Note that as an alternative, holding section 34 may be attached to top wall 33. Moreover, as an alternative to holding section 34 including thin, plate-like insertion tongue part 34*a* and holding part 34*b*, holding section 34 may be a shaft-shaped component that holds guide body 35. Other various embodiments of holding section 34 that holds guide body 35 are possible.

Moreover, in this embodiment, rotation storage body 10 is configured to turn around by rotating at least 180 degrees, but as an alternative to this example, rotation storage body 10 may rotate at least 90 degrees while being pulled out from box 2.

Moreover, box 2 may open at least toward the front, and may open toward the front and toward the rear.

Moreover, the objects to be stored in rotation storage device 1 are not limited to the footwear like shoes as exemplified above; objects to be stored include, for example, clothing, umbrellas, and hats, as well as other objects often stored in entrance halls, and additionally books, accessories, tableware, spices, and storage media such as various types of discs. In this case, shelves 17 that partition rotation storage body 10 may be appropriately changed in shape, and a hook component for hooking objects to be stored in rotation storage body 10 may be provided.

REFERENCE MARKS IN THE DRAWINGS

1 rotation storage device (storage device)
2 box
3*a* top surface
10 rotation storage body (storage body)
30 top rotation mechanism section (rotation mechanism section)
31 stationary rail
32 guide groove
33 top wall
34 holding section
34*a* insertion tongue part
35 guide roller (guide body)
40 movable rail
41 receiving groove
42 slit opening
43 bottom wall
44 rotational shaft (shaft extending along the up-down direction)
45 front end wall
46 first sidewall (first sidewall among the left and right sidewalls)
47 second sidewall
48 top wall

The invention claimed is:

1. A storage device including, in a box having an open front, a rotation mechanism section that rotatably holds a storage body that stores an object, the storage body being rotatable about a shaft extending along an up-down direction, wherein the rotation mechanism section includes a stationary rail affixed to a top surface of the box and a movable rail coupled to the storage body via the shaft, the stationary rail including: a guide groove open downward and forward and extending in a front-back direction; and a guide body on a holding section protruding downward from a groove bottom surface of the guide groove, the movable rail being movable in the front-back direction along the guide groove in the stationary rail, and the movable rail includes left and right sidewalls, a bottom wall, a front end wall, and a top wall, the left and right sidewalls, the bottom wall, and the front end wall defining a receiving groove for receiving the guide body, the top wall forming a slit opening for receiving the holding section.

2. The storage device according to claim 1, wherein the movable rail has a structure in which the slit opening is located between (i) one of left and right ends of the top wall and (ii) a top end of one of the left and right sidewalls.

3. The storage device according to claim 1, wherein the holding section includes an insertion tongue part whose thickness direction extends along a left-right direction and that inserts into the slit opening.

4. The storage device according to claim 3, wherein the holding section is formed by cutting and raising a top wall defining the groove bottom surface of the stationary rail.

* * * * *